US011871826B2

(12) United States Patent
Mabatano-Harris

(10) Patent No.: US 11,871,826 B2
(45) Date of Patent: Jan. 16, 2024

(54) METHOD AND AN APPARATUS FOR HAIR STYLING

(71) Applicant: Stasha Mabatano-Harris, Franklin Square, NY (US)

(72) Inventor: Stasha Mabatano-Harris, Franklin Square, NY (US)

( * ) Notice: Subject to any disclaimer, the term of this patent is extended or adjusted under 35 U.S.C. 154(b) by 0 days.

(21) Appl. No.: 17/171,364

(22) Filed: Feb. 9, 2021

(65) Prior Publication Data

US 2022/0248825 A1 Aug. 11, 2022

(51) Int. Cl.

| | |
|---|---|
| ***A41G 3/00*** | (2006.01) |
| ***A45D 2/00*** | (2006.01) |
| ***A41G 5/00*** | (2006.01) |
| ***A45D 7/00*** | (2006.01) |

(52) U.S. Cl.

CPC ..... *A45D 2/00* (2013.01); *A41G 5/0086* (2013.01); *A45D 7/00* (2013.01); *A45D 2002/005* (2013.01); *A45D 2007/004* (2013.01)

(58) Field of Classification Search

CPC ..... A45D 44/00; A45D 44/04; A45D 44/06; A45D 44/14; A45D 8/34; A45D 7/02; A41G 5/00; A41G 5/0086

See application file for complete search history.

(56) References Cited

U.S. PATENT DOCUMENTS

| | | | | |
|---|---|---|---|---|
| 3,070,906 | A * | 1/1963 | Tinsley | A45D 29/18 434/100 |
| 2015/0196143 | A1* | 7/2015 | Sterling | F16M 13/022 248/339 |
| 2017/0356123 | A1* | 12/2017 | Sopoliga | D06F 59/06 |
| 2019/0223514 | A1* | 7/2019 | Bunn | A47F 7/24 |

OTHER PUBLICATIONS

Https://www.youtube.com/watch?v=kLq1pdaWaOk (Year: 2018).*

* cited by examiner

*Primary Examiner* — Cris L. Rodriguez
*Assistant Examiner* — Karim Asqiriba
(74) *Attorney, Agent, or Firm* — Carter, DeLuca & Farrell LLP

(57) ABSTRACT

A method and apparatus for styling hair using an apparatus preferably shaped as a hand having finger like elements that are flexible and can be separated from each so that a strand of hair can be inserted in between two of the finger like elements so that the strand is held in place as its being braided. The apparatus is mounted on a base with a clamp for securing the apparatus to a chair, table or other surface to keep the apparatus in place during the braiding of each strand of hair being braided. In another embodiment the apparatus can have three flexible elements that are generally upwardly extending from supporting surface such as a hand like or other structure so that two strands can be placed in between the places between the two end elements and the middle element for braiding.

11 Claims, 4 Drawing Sheets

METHOD AND AN APPARATUS FOR HAIR STYLING

RELATED APPLICATIONS

The present application is a continuation in part of Ser. No. 62/979,163 filed on Feb. 25, 2020 and claims priority thereunder.

BACKGROUND OF THE INVENTION

1. Field of the Invention

The present invention relates to a method and an apparatus for styling hair. In particular the present invention relates to a method and apparatus for styling hair using an apparatus that eliminates the need for a person to hold the hair extensions in their hand while their hair is being braided.

2. The Related Prior Art

Conventionally a person having his or her hair braided needs to hold the hair extensions in their hand for the stylist to have easy access to the hair extensions. This can be tiresome and inconvenient when a person is at a salon. Moreover it is difficult for a stylist to accomplish braiding and adding a strand of the hair extensions if there is not an available person to hold the extension. It would therefore be desirable to have a more effective and comfortable method and apparatus for accomplishing braiding that does not require a person having their hair braided to hold one or more extensions in their hand.

SUMMARY OF THE INVENTION

The present invention provides for a method and an apparatus for styling hair. In particular the present invention relates to a method and apparatus for styling hair using an apparatus that eliminate the need for a person to hold strand of his or her hair while the strand of hair is being braided. This is accomplished with an apparatus preferably shaped as a hand having finger like elements that are spread apart from each other so that hair extensions are held in place. The apparatus is preferably flexible and can be bent or and capable of having the finger like elements spread apart from each other so that a strand of hair can be inserted in between two of the finger like elements so that the strand is held in place as its being braided by either the person hair stylist or the person whose hair it is and is self-styling and braiding in the extensions. The apparatus is mounted on a base with a clamp for securing the apparatus to a chair, table or other surface to keep the apparatus in place during the braiding of each strand of hair being braided.

In another embodiment of the invention the apparatus can have three flexible element that are generally vertically extending from supporting surface such as a hand like or other structure so that hair extensions can be placed in between the thumb-like finger and index-like finger or any other finger-like elements on the apparatus. In this way the different types of extensions e.g. curly or straight or of different colors e.g. red or black can be inserted for braiding. The apparatus can be flexible and have a base with a clamp to secure to a surface as with the early aforementioned embodiment of The Practice Hand.

DETAILED DESCRIPTION OF THE DRAWINGS

Figure 1:
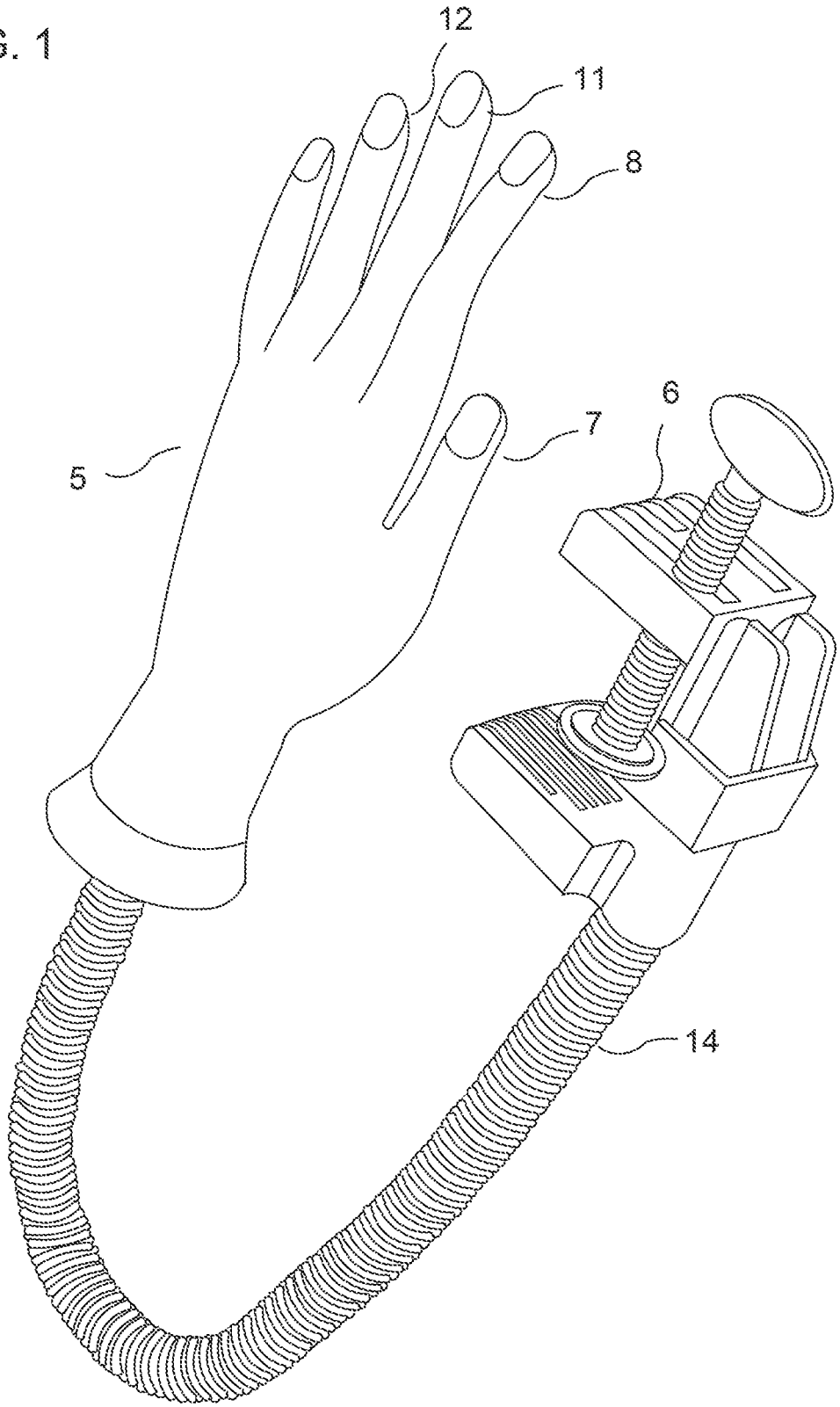
FIG. 1 discloses a mannequin hand called the Practice Hand for Nails used for practicing one's nail enhancing skills on that is used for the methodology of the present invention.
Figure 2:
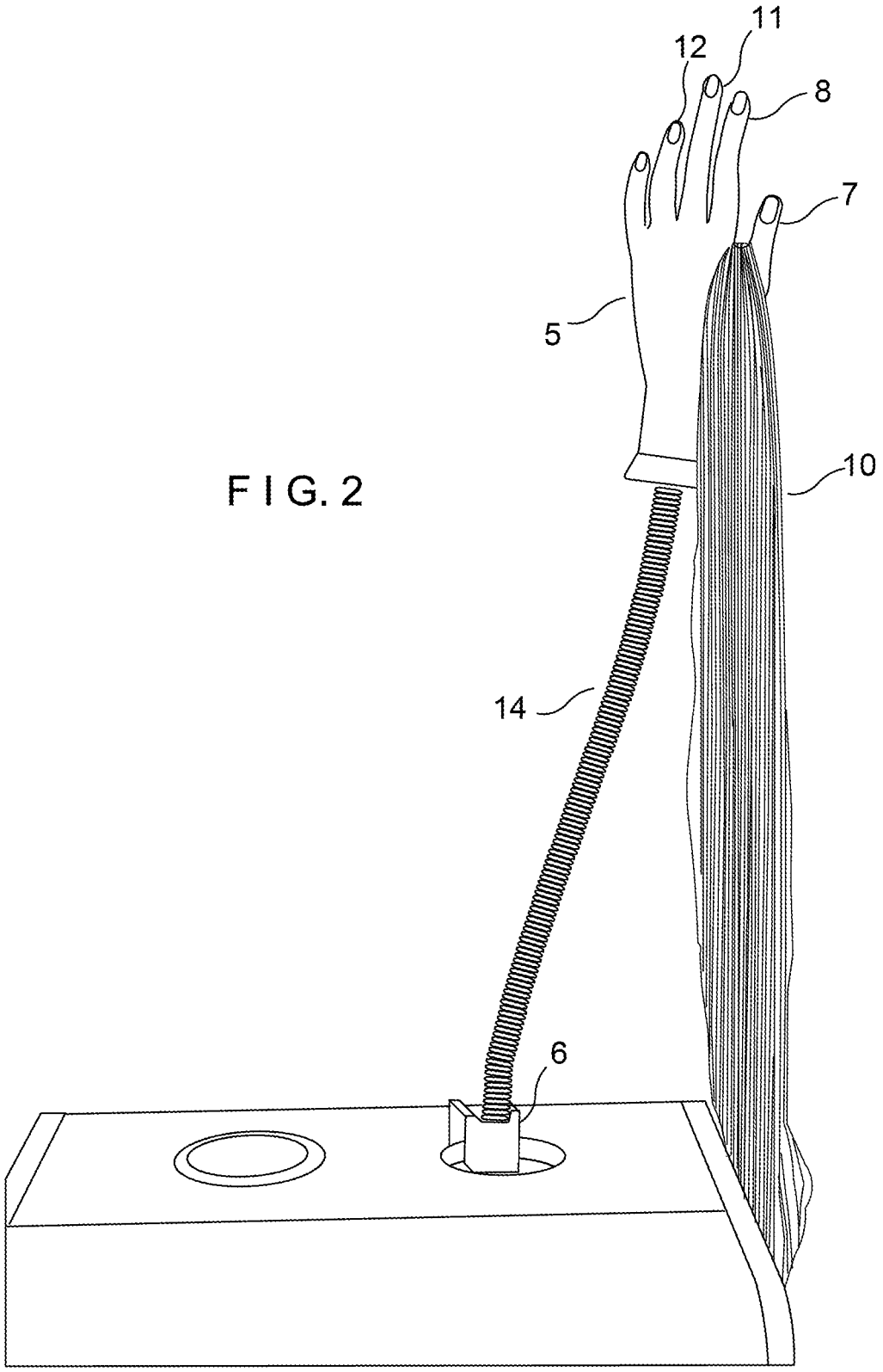
FIG. 2 shows a slightly modified version of the Practice Hand of FIG. 1 in that it the mannequin hand is now in a black color rather than flesh tone color with hair extensions inserted through two of the finger elements for braiding the hair extensions in accordance with the methodology of the present invention.

Referring now to the drawings, FIG. 1 discloses a mannequin hand made of silicon material that is commercially available for developing one's nail enhancing skills and sold online as Practice Hand for Nails and made by Guangzhou Jiu Yu Plastic Products Co., Ltd located at Address Taipingyang IND Xingtang town Guangzhou-Zeng Cheng 511340 China The present invention has a methodology for adapting his device for one or more hair extensions for braiding. The methodology involves clamping the device to a table or chair or the surface with a clamp 6 and then pulling a strand 10 of the hair extension through preferably either between finger-like elements of the thumb 7 and forefinger 8 or alternatively the middle finger 11 and the ring finger 12 and braiding the hair extension to create the desired braid (see FIG. 2 which shows the hand 5 modified in black). This would eliminate the need for a person to hold the hair extensions 10 as both of the person's hands would now be free to braid. The apparatus of FIG. 1 apparatus 5 has a flexible neck like piece 14 which can be used to better position the apparatus structure 5 for braiding a person's hair.

Figure 3:
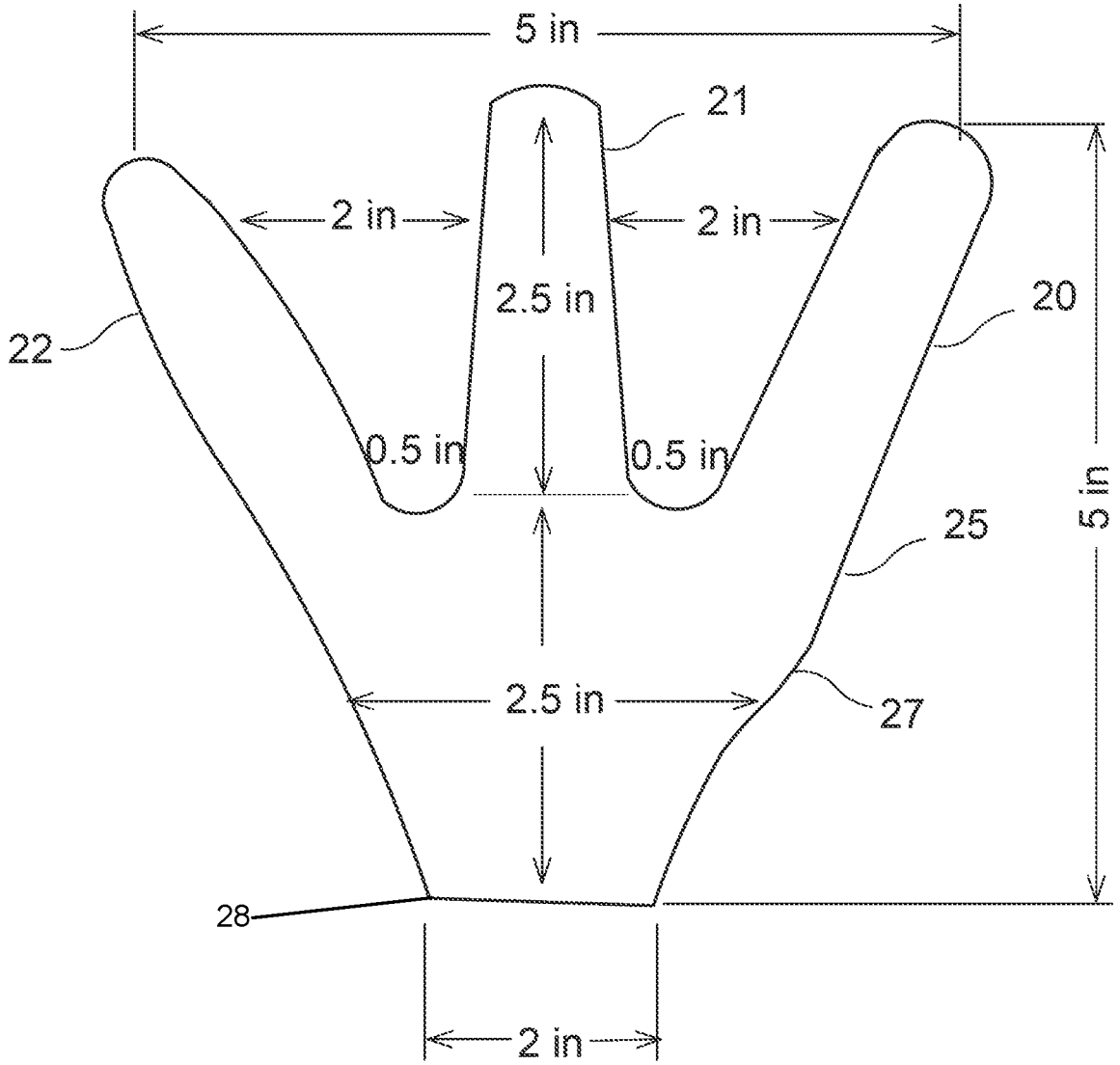
FIG. 3 discloses another embodiment of the present invention showing an apparatus having three substantially upwardly extending elements in a substantially vertical direction with the two elements on the ends of the apparatus bending slightly outward from the middle element and all three element extending upward from a portion preferably integrally formed with the three elements wherein strands of hair can be inserted between each of the end elements and the middle element for braiding. The apparatus can as is the case for the apparatus of FIG. 1 have a base with a clamp for attaching to table, chair or other surface and a flexible neck like piece for position the apparatus structure.

FIG. 3 is another embodiment of the present invention. In which apparatus may be constructed with three finger-like elements 20, 21, 22 extending from base portion. It is preferably integrally made. The apparatus 5 is preferably made of silicon material and is bendable and flexible so that the two end elements 20, 21, 22 extending from the base 28 can be bent away from the middle element 21 for more room for the strands 10 of the hair extension to be pulled through for braiding. The bottom of base 28 is preferably rounded with a two-inch round bottom surface and a clamp 6 can be added to hold it in place. The width of the base portion is preferably 2.5 inches wide. The finger-like elements 20, 21, 22 are approximately preferably 2.5 inches long. The distance between each element may be between 0.5 inches to 2.5 inches when bent or flexed outward. The overall width of the apparatus 5 measured from the two end elements 20, 22 when flexed out to the maximum are preferably 5 inches. The height of the apparatus 5 is approximately 5 inches.

Figure 4:
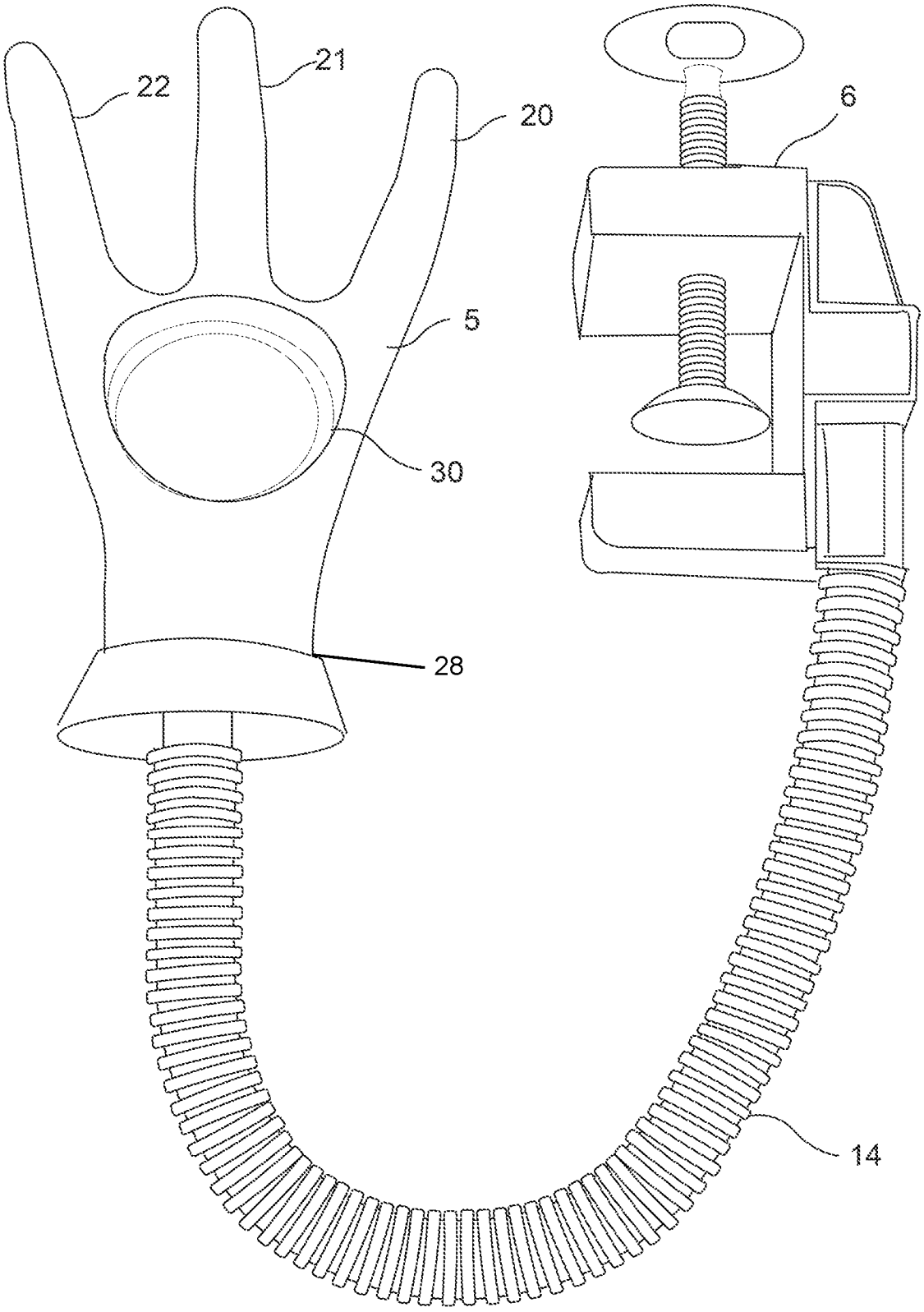
FIG. 4 is a modified embodiment of FIG. 3 in a perspective view with the palm of the hand containing a preferably circular shaped recess for holding hair product for braiding hair.

FIG. 4 is a modified embodiment of FIG. 3 in a perspective view with the palm of the hand-shaped apparatus 5 has a preferably circular shaped recess 30 for holding hair product for braiding hair. This embodiment includes the base 28 and the clamp 6 described in FIG. 3

While presently preferred embodiments have been described for purposes of the disclosure, numerous changes in the arrangement of method steps and those skilled in the art can make apparatus parts. Such changes are encompassed within the spirit of the invention as defined by the appended claims.

The invention claimed is:

1. An apparatus for braiding one or more hair extensions, the apparatus comprising:

a base portion consisting of:

a central surface;

a bottom surface; and only three finger elements extending upright from the base portion, wherein the three finger elements, include:

a first finger defining a longitudinal axis and having a first side and second side:

a second finger positioned adjacent to the first side of the first finger, wherein the second finger moves laterally relative to the first side of the first finger such that a hair extension can be inserted upon expansion and clamped upon contraction; and a third finger positioned adjacent to the second side of the first finger, wherein the third finger expands and contracts laterally relative to the second side of the first finger, such that a hair extension can be inserted upon expansion and clamped upon contraction.

2. The apparatus for braiding one or more hair extensions according to claim 1, wherein the three finger elements and the base portion of the apparatus are integrally formed.

3. The apparatus for braiding one or more hair extensions according to claim 1, wherein the apparatus is made of silicon material.

4. The apparatus for braiding one or more hair extensions according to claim 1, wherein a bottom of the base portion includes an approximately two-inch round bottom surface.

5. The apparatus for braiding one or more hair extensions according to claim 1, wherein the base portion has a width that is approximately 2.5 inches wide, and the finger elements are approximately 2.5 inches long,_ and wherein a distance between each finger element relative to a next one ranges from about 0.5 inches to about 2.5 inches when the second finger and third finger are bent or flexed outward from the first finger.

6. The apparatus for braiding one or more hair extensions according to claim 1, wherein the bottom surface of the base portion is rounded with a two inch round bottom surface, and a width of the base portion is approximately 2.5 inches wide, and the finger elements are approximately 2.5 inches long and a distance between the first finger and second finger and the first finger and third finger is in an approximate range of from 0.5 inches to 2.5 inches when the second finger and third finger are bent or flexed outward.

7. The apparatus for braiding one or more hair extensions according to claim 1, wherein an overall width of the apparatus measured from the second finger and third finger when the second and third fingers are flexed out to a maximum overall width is approximately 5 inches.

8. The apparatus for braiding one or more hair extensions according to claim 1, wherein a height of the apparatus is approximately 5 inches.

9. The apparatus for braiding one or more hair extensions according to claim 1, wherein the central surface of the base portion includes recess for holding a hair product for braiding hair.

10. The apparatus for braiding one or more hair extensions according to claim 9, wherein the recess is centrally located on the central surface of the base portion and has a circular shape.

11. The apparatus for braiding one or more hair extensions according to claim 1, wherein the bottom surface of the base portion includes a clamp, wherein the clamp is configured to secure the apparatus to a chair, table, or other surface.

* * * * *